United States Patent [19]

Nakatani et al.

[11] Patent Number: 4,806,978

[45] Date of Patent: Feb. 21, 1989

[54] IMAGE EDITING SYSTEM

[75] Inventors: Keiji Nakatani, Toyokawa; Kenji Shibazaki, Aichi, both of Japan

[73] Assignee: Minolta Camera Kabushiki Kaisha, Osaka, Japan

[21] Appl. No.: 101,255

[22] Filed: Sep. 25, 1987

[30] Foreign Application Priority Data

Sep. 27, 1986 [JP] Japan ..... 61-229067

[51] Int. Cl.[4] ..... G03G 15/00

[52] U.S. Cl. ..... 355/14 R; 355/7

[58] Field of Search ..... 355/14 R, 3 R, 7, 14 C, 355/133

[56] References Cited

U.S. PATENT DOCUMENTS

| | | | |
|---|---|---|---|
| 4,110,794 | 8/1978 | Lester et al. | 355/3 R |
| 4,182,568 | 1/1980 | Levine | 355/14 R |
| 4,194,833 | 3/1980 | Lester et al. | 355/3 R |
| 4,256,400 | 5/1981 | Komori et al. | 355/14 |
| 4,582,417 | 4/1986 | Yagasaki et al. | 355/7 |
| 4,627,707 | 12/1986 | Tani et al. | 355/14 |
| 4,653,899 | 3/1987 | Watanabe et al. | 355/14 |

*Primary Examiner*—R. L. Moses

*Attorney, Agent, or Firm*—Price, Gess & Ubell

[57] ABSTRACT

An image editing system which comprises a memory device capable of storing editing data in memory, copying device to perform edited-image copying based on data stored in the memory device which is attached to the copying device, and an input device, which is separate from the copying device, for entering edited data in the memory device.

12 Claims, 8 Drawing Sheets

IMAGE EDITING SYSTEM

BACKGROUND OF THE INVENTION (1) Field Of The Invention

The present invention relates to an image editing system comprising, in detail, a memory card for storing the edited-image data in memory, copying apparatus with image editing capability, and an input unit for storing data in memory.

(2) Prior Art

There are many proposals for conventional electrophotographic copy machines having editing functions that allow editing images in specific regions of an original document and some have been actually produced. Many conditions must be entered in specific sequences in order to perform edited-image copying. Accordingly, the copy machine is occupied for long periods by a single user editing images for copying, while other potential users are forced to wait for long periods to use the machine and, consequently, the use-efficiency of the copy machine is reduced.

SUMMARY OF THE INVENTION

An object of the present invention is to provide an image editing system capable of highly efficient edited-image copying.

The aforesaid object is accomplished by an image editing system comprising a memory card capable of storing edited-image data in memory, copying device to perform edited-image copying based on data stored in said memory card which is removable, and an input unit for entering edited data in a memory card which is removable.

BRIEF DESCRIPTION OF THE DRAWINGS

These and other objects, advantages and features of the invention will become apparent from the following description thereof taken in conjunction with the accompanying drawings which illustrate specific embodiments of the invention.

In the following description, like parts are designated by like reference numbers throughout the several drawings.

DETAILED DESCRIPTION OF THE PREFERRED EMBODIMENT

Figure 1:
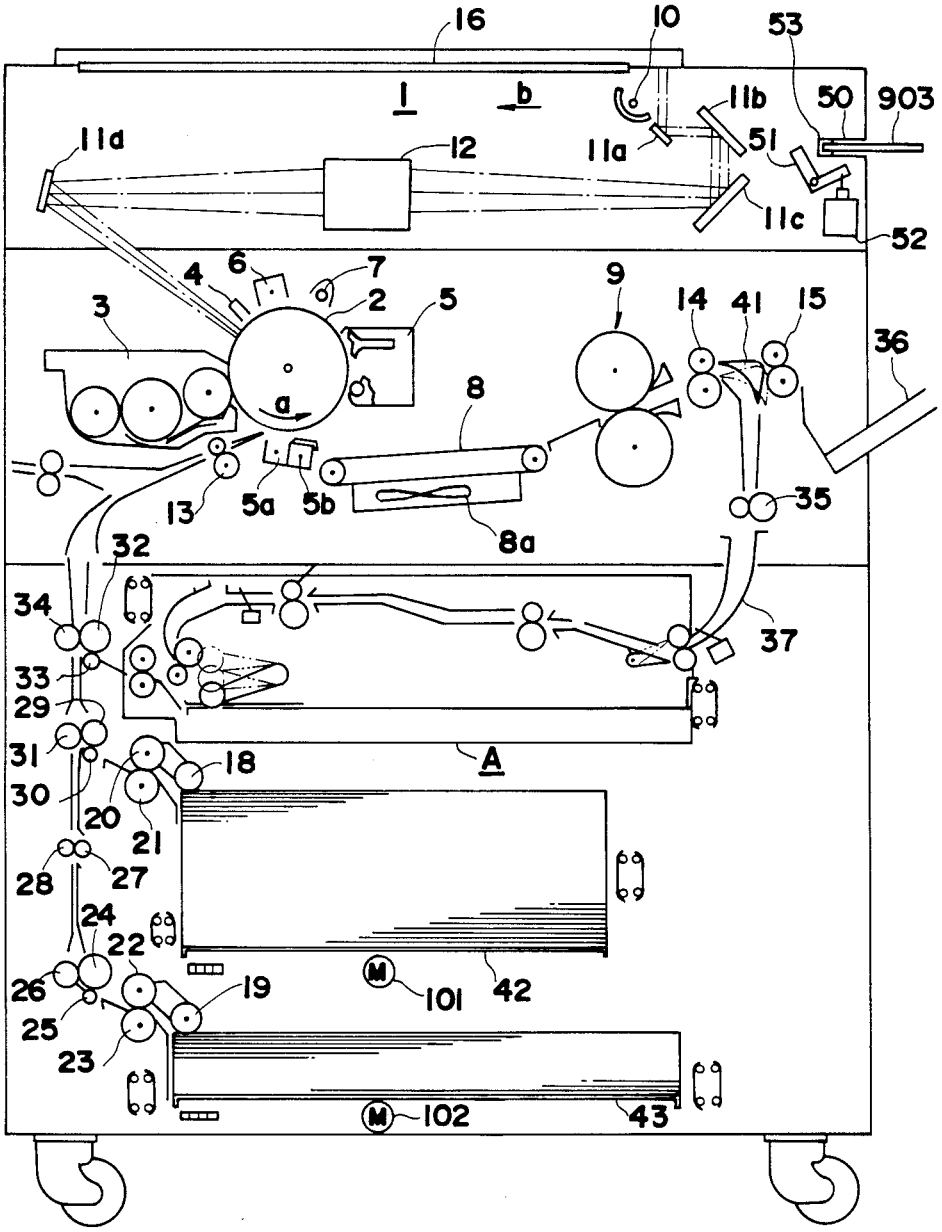
FIG. 1 is a section view showing the abbreviated construction of a copy machine having an edited-image copy function.

FIG. 1 shows the construction of a copy machine having editing functions. This copy machine comprises copy paper storage sections 42 and 43 and an intermediate tray unit A in a lower level, an image forming section having a photosensitive drum 2 provided centrally therein in an intermediate level, and an optical system 1 in an upper level, said copy machine having composite and duplex copying to intermediate tray unit A after said copy paper has undergone a first copying process The aforesaid photosensitive drum 2 is rotatable in the direction indicated by the arrow (a) and has sequentially disposed around its periphery a sensitizing charger 6, magnetic brush developing unit 3, transfer charger 5*a*, separation charger 5*b*, blade-type cleaning device 5, and an eraser lamp 7. Photosensitive drum 2 is uniformly charged by sensitizing charger 6 via its rotation in the direction indicated by arrow (a), and has an electrostatic image formed thereon following an image exposure from optical system 1, said electrostatic image being developed into a toner image by means of developing device 3. In addition, sensitizing charger 6 and developing device 3 have an eraser lamp 4 provided therebetween in the proximity of photosensitive drum 2.

Optical system 1 is capable of scanning original documents in the direction indicated by arrow (b) from the underside of glass document platen 16, and comprises an exposure lamp 10, movable mirrors 11*a*, 11*b* and 11*c*, image formation lens 12, and a stationary mirror 11*d*.

The copy paper storage area comprises a top elevator-type storage section 42 and a bottom elevator-type storage section 43. The copy paper stored in said storage sections 42 and 43 is fed in an upward direction via the actuation of either top elevator lifting motor 101 or bottom elevator lifting motor 102, respectively, depending on which paper is being supplied.

Copy paper in storage section 42 and storage section 43 is selectively supplied sheet by sheet by guide rollers 21 and 22 via the rotation of paper roller 18 or by guide rollers 22 and 23 via the rotation of paper roller 19, respectively, and hence said paper is fed to timing roller 13 via rollers 32 and 34 and rollers 27 and 28 by feed rollers 29, 30, 31 or by feed rollers 24, 25, 26, respectively.

After stopping temporarily at timing roller 13, the copy paper is fed to the transfer section in synchronized timing with the image formed on the aforesaid photosensitive drum 2, whereupon the previously mentioned toner image is transferred to said copy paper via charging by transfer charger 5*a* and the paper is separated from the surface of said photosensitive drum 2 by means of a charge imparted by separation charger 5*b*, then the copy paper is fed via feed belt 8, which is provided with an air suction means 8*a*, to fixing device 9 where the toner image undergoes a fixing process.

Feed roller set 14 and discharge roller set 15 disposed immediately behind the outlet to said fixing device 9 have provided therebetween a lever 41 for switching the copy paper feed path. When a simplex copy is made and the lever 41 is set in the position described by the broken line in FIG. 1, copy paper arriving from the fixing device 9 is discharged to tray 36 from discharge roller set 15. When a duplex or composite copy is made, however, and the lever 41 is set in the position described by the solid line in FIG. 1, the copy paper passes from feed roller set 35, transits guide plate 37, and is fed to the intermediate tray unit A described in detail hereinafter.

On the other hand, following the image transfer, photosensitive drum 2 has the residual toner removed therefrom via a cleaning device 5, and also has the residual charge removed therefrom via photic exposure produced by eraser lamp 7, whereupon said drum is ready for a subsequent copying process.

An explanation of the construction of intermediate tray unit A is abbreviated herein because it is substantially the same as that disclosed by Hanada et al. in U.S. patent Ser. No. 175,612 (filed on June 18, 1986).

An opening 50 is provided at the top edge of the copy machine for the insertion of memory card 903 which stores the data for edited-image copying. The opening 50 has provided therein an ejection lever 51 for ejecting the inserted memory card and a lever-actuating solenoid 52. In addition, the opening 50 has provided therein a connector 53 for electrically connecting the memory card to the copy machine.

Figure 2:
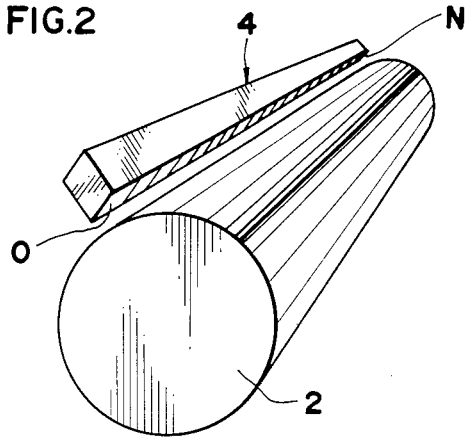
FIG. 2 is a perspective illustration showing the relationship of the photosensitive drum and the eraser.
Figure 3:
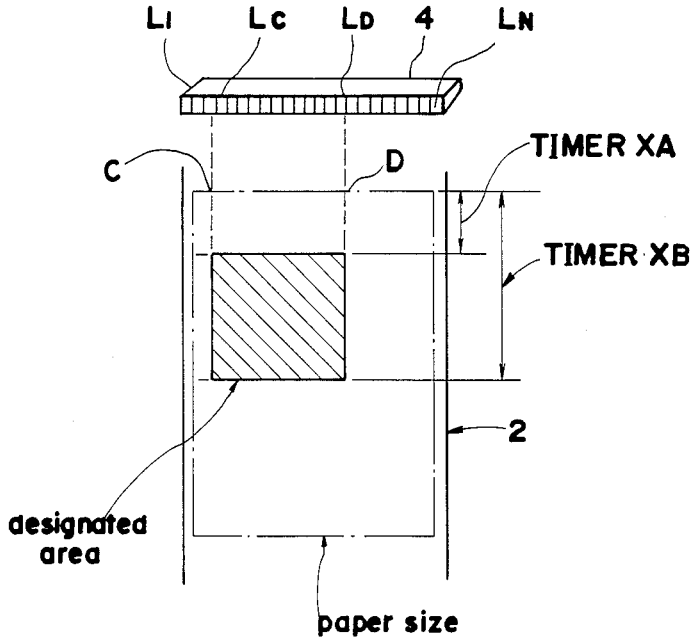
FIG. 3 is an illustration to explain the eraser operation.

FIG. 2 shows the positional relationship of eraser 4 and photosensitive drum 2. FIG. 3 is an illustration explaining the circumstances for erasing the image of a specific area via eraser 4. Eraser 4 is provided with an LED (light emitting diode) array comprising a total of "N" individual LEDs disposed in a single row, and said eraser 4 eliminates the charge in a corresponding region on photosensitive drum 2 by selectively emitting a specific quantity of light from various LEDs, thus erasing the electrostatic image in a particular region.

For example, suppose there are a total of "N" LEDs labeled, from left to right, L1, L2, . . . LN, as shown in FIG. 3, then if LEDs LC to LD are switched ON from the instant timer A reaches completion until the instant timer B reaches completion, the charge is eliminated within the area on photosensitive drum 2 which corresponds to the shaded portion in the drawing, and an electrostatic image is not formed within said area. Details of the illumination control of eraser 4 are disclosed by Ohira et al. in U.S. patent application Ser. No. 5,743 (filed on July 21, 1987) and, therefore, a detailed explanation of same is abbreviated herein.

Figure 4:
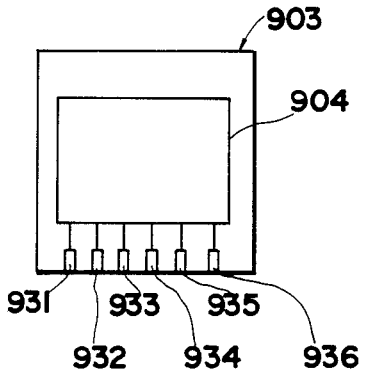
FIG. 4 is an illustration showing an abbreviated construction of the memory card.

FIG. 4 shows the construction of memory card 903. Memory card 903 comprises an EEPROM (Electrically Erasable and Programmable Read Only Memory) which is provided with a power terminal 931, write/-read terminal 932, data terminal 933, clock terminal 934, strobe terminal 935, and a grounded terminal 936.

Figure 5:
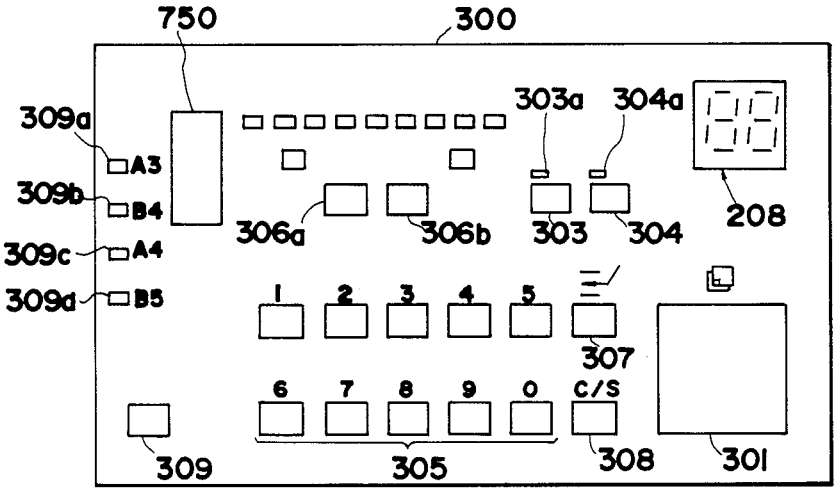
FIG. 5 is a drawing showing the copy machine operation panel layout.

FIG. 5 is an explanatory drawing which shows a portion of the operation panel of the aforesaid copy machine.

The keys illustrated in the drawing are: print key 301, paper size selection key 309 and indicators 309*a* to 309*d*, ten numerical input keys 305, interrupt key 307, clear/-stop key 308, density setting keys 306*a* and 306*b*, duplex mode key 303 and indicator 303*a*, composite mode key 304 and indicator 304*a*, display section 208, and copy paper residual and capacity indicator 750.

The aforesaid copy machine assigns copy operating conditions and operation modes by means of the operation of the various keys of the operation panel, and also provides an edit-image copy mode in accordance with data stored in memory card 903.

Figure 6:
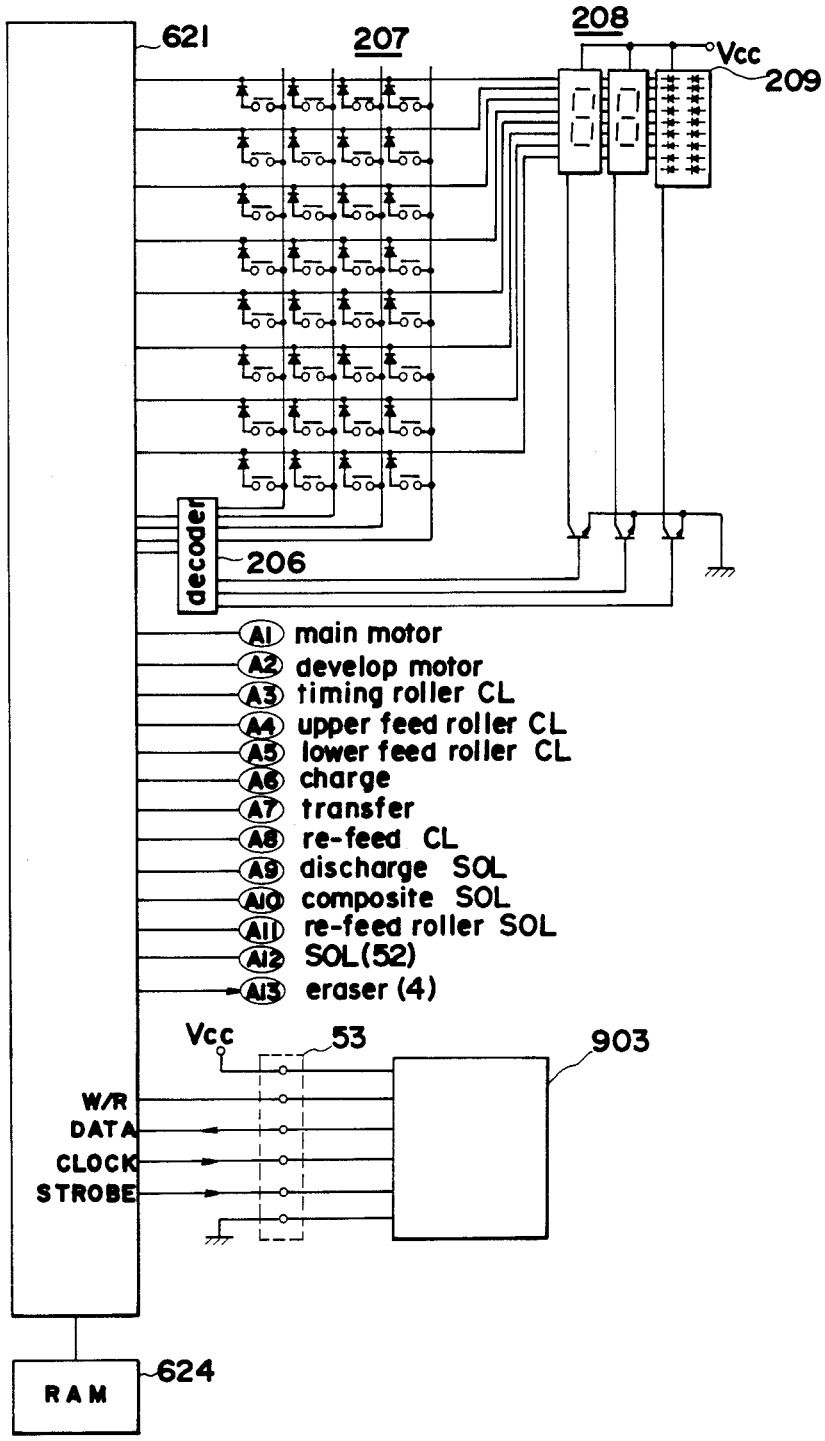
FIG. 6 is a circuit diagram showing an abbreviated construction of the copy machine control circuit.

FIG. 6 shows the copy machine control circuit centrally disposed in microcomputer 621. Microcomputer 621 has connected thereto via decoder 206 a switch matrix 207, comprising the various keys on operation panel 300 and various sensors, copy number display section 208, and display section 209.

The microcomputer 621 port A1–A13 has connected thereto a main motor, developing motor, timing roller clutch, upper feed roller clutch, lower feed roller clutch, sensitizing charger, transfer charger, re-feed clutch, discharge solenoid, composite solenoid, re-feed roller solenoid, card ejection solenoid, and an image interval eraser. In addition, microcomputer 621 W/R data, clock and strobe ports have connected thereto via connector 53 a memory card 903. Also, RAM 624 is connected to microcomputer 621.

Figure 7:
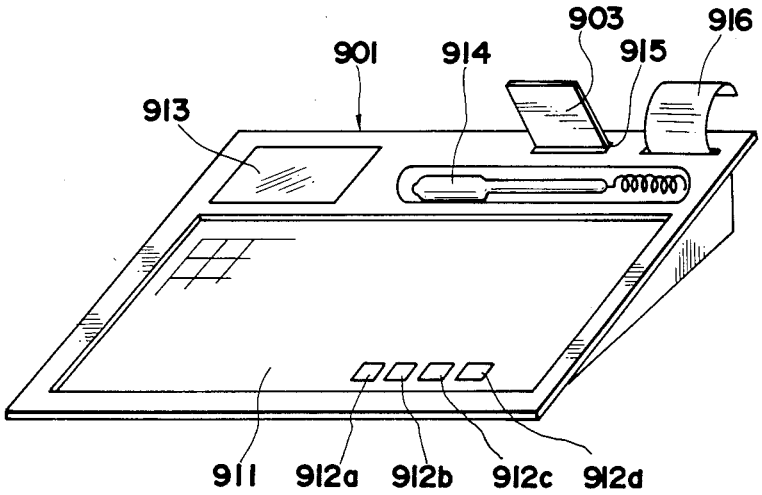
FIG. 7 is a perspective diagram showing the input unit.

FIG. 7 shows input unit 901 for entering editing data to memory card 903. Input unit 901 is a stand-alone module which is independent of the copy machine, said unit comprising tablet 911 that is capable of entering coordinate data via the application of pressure to positions on said tablet, trimming key 912*a* which assigns the trimming mode for copying the image within a specified area, masking key 912*b* which assigns the masking mode for erasing the image within a specified area, end key 912*c* which terminates the coordinate data input process, clear key 912*d* which erases the input coordinate data, display section 913 which displays the input coordinate data and selection modes, stylus 914 for applying pressure to tablet 911, and an insert section 915 for memory card 903. Insert section 915 has provided therein a connector 953 for electrically connecting memory card 903 and input unit 901. Furthermore, input unit 901 has provided therein in a internal area a small printer 952. The small printer 952 prints the information displayed in display section 913 on recording paper 916.

Figure 8:
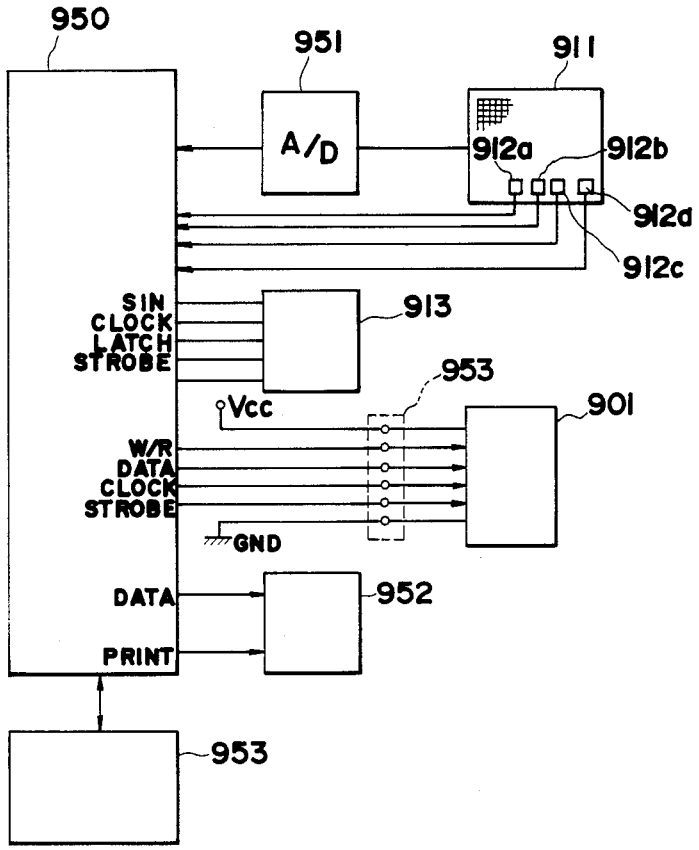
FIG. 8 is a circuit diagram showing the abbreviated construction at the input unit control circuit.

FIG. 8 is a circuit diagram showing the control circuit for input unit 901, said control circuit being centrally provided in microcomputer 950. Microcomputer 950 has a tablet 911 connected thereto via an A/D converter 951. Keys 912*a* to 912*d*, display section 913 and printer 952 are also connected to microcomputer 950. Memory card 903 is connected to microcomputer 950 via connector 953, said connector being a RAM connector.

Figure 9:
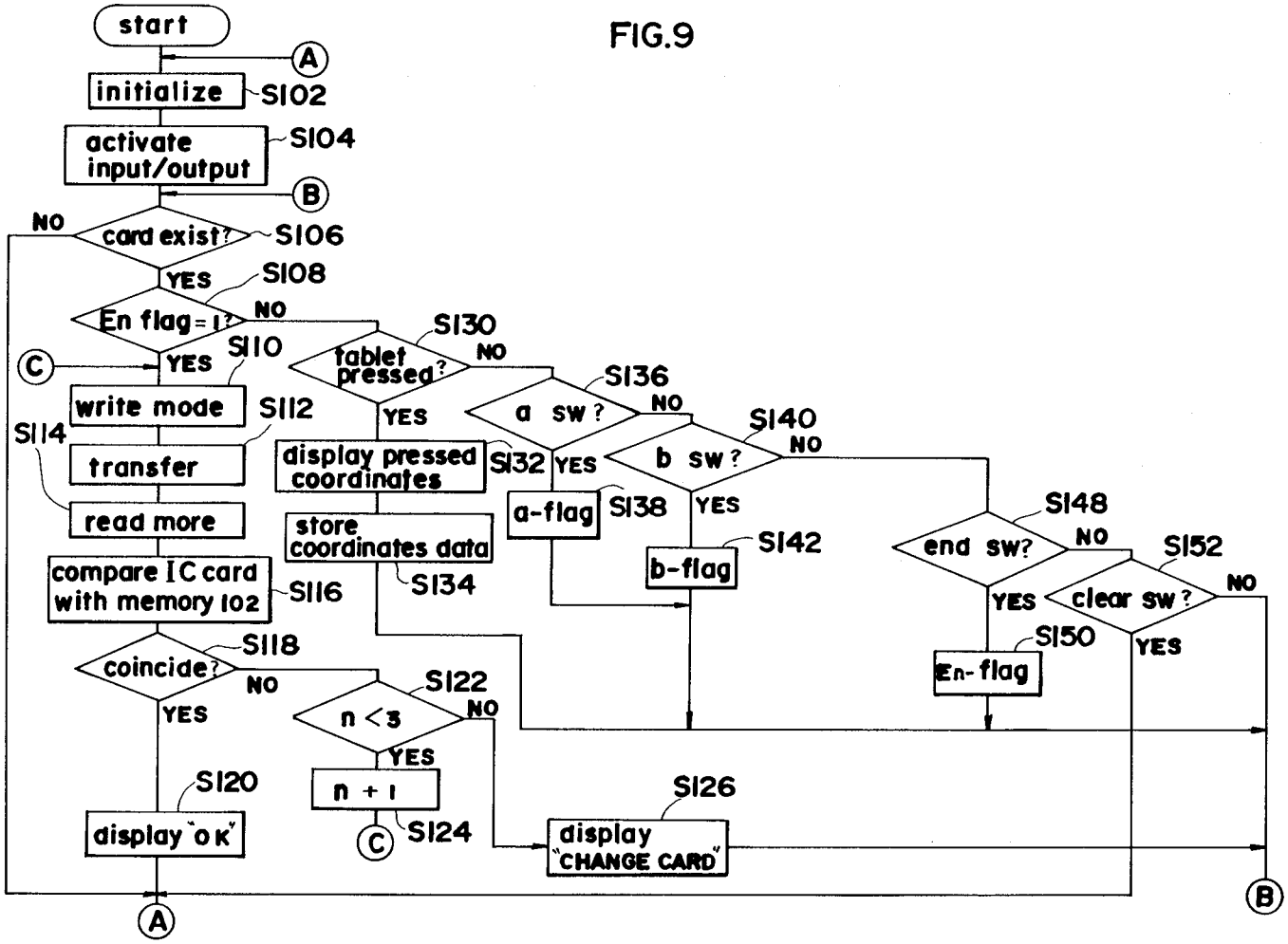
FIG. 9 is a flow chart showing the procedure for entering editing data to the memory card.

FIG. 9 is a flow chart showing the processing sequence for storing the editing data in memory card 903 using the input unit 901.

First, in step S102, microcomputer 950 is initialized and the input/output is activated in step S104. Then, in step S106, the existence of memory card 903 is determined (a determination is made as to whether or not memory card 903 has been inserted into insert section 915, said card 903 being connected to input unit 901 via RAM connector 953).

If card 903 is not present, then the routine returns to step S102; if said card 903 is present, then the routine continues to step S108.

In step S108, the end flag (En-flag) is examined. The En-flag is set by depressing the end key after completing the data input via the editing input unit 901.

When the En-flag is set, the routine continues to steps S110 to S126 and the data are stored in memory card 903. First, the write mode is set (S110) and the data stored in RAM 953 and the flag status are stored in the memory card 903 (S112). Then, the write mode is set (step S114), and the data stored in memory card 903 are read (S116). In step S118, the data stored in RAM 953 and the data read from memory card 903 are checked to determine whether or not they coincide (S118).

When said data coincide, the routine continues to step S120 because the data were correctly stored in memory card 903, and an "OK" notice is displayed in display section 913.

When said data do not coincide, the routine continues to step S122 and beyond. The routine processes steps S110 to S118 up to three times and if said data do not coincide by the third process, the memory card 903 is determined to be defective and a "replace card" notice is displayed (S126).

When the En-flag is lowered in the aforesaid step S108, the routine continues to step S130 and beyond where coordinate data are input. First, in step S130, a check is run to determine whether or not pressure has been applied to tablet 911 via stylus 914. If data have been entered, the routine progresses to step S132 and beyond; if the input coordinate data are not displayed, then said coordinate data are stored in memory 953 (S134).

When there is no tablet input in step S130, the routine progresses to step S136 and beyond where a check is made for input from keys 912*a* to 912*d* and the flags are set to correspond with said key input, i.e., when trimming key 912*a* is depressed (step S136), the "a" flag is raised (S138); when masking key 912*b* is depressed (S140), the "b" flag is raised (S142); when the end key 912*c* is depressed (S148), the En-flag is raised (S150); and when the clear key 912*d* is depressed the routine returns to step S102.

Editing data are input to memory card 903 according to the aforesaid sequence. Memory card 903, having the editing data entered therein, is extracted from the insert section 915 of the input unit 901, said card being subsequently inserted into opening 50 of the copy machine. Thereupon, the copy machine performs the edited-image copying process in accordance with the editing data stored in memory card 903.

Figure 10:
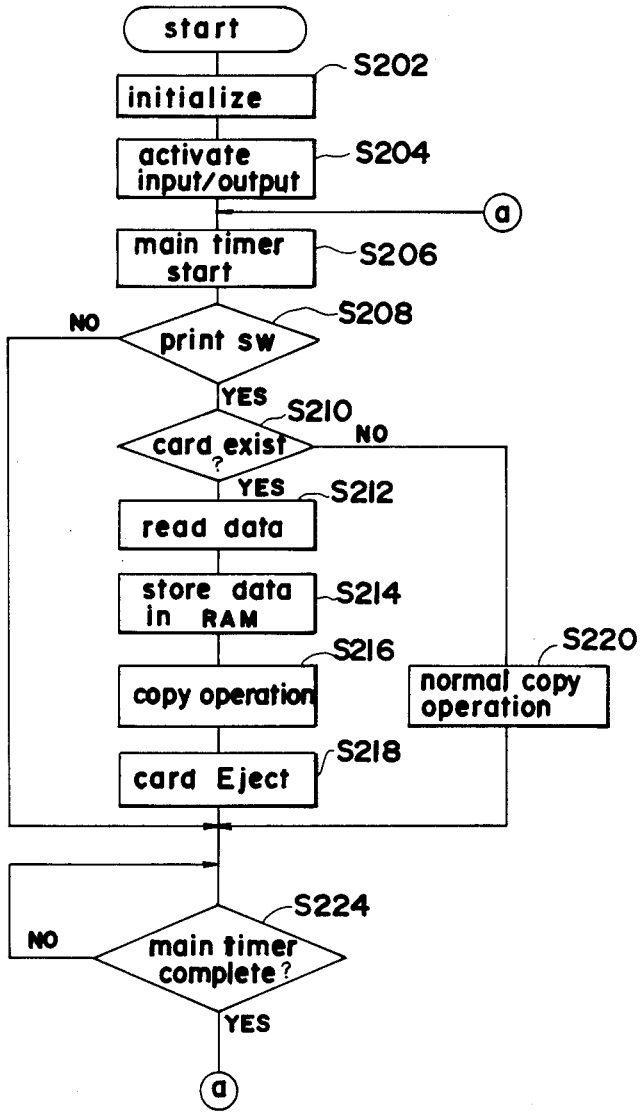
FIG. 10 is a flow chart briefly showing the copy machine operating procedure.

FIG. 10 is a flow chart showing the actual processing performed via microcomputer 621 of the copy machine.

First, in step S202, microcomputer 621 is initialized and then, in step S204, the input/output is activated. Next, the main timer is set which defines the time period for one routine (S206), and the existence of print switch input is determined in step S208.

When print switch input exists, a check is made in step S210 to determine whether or not the memory card 903 is inserted into opening 50. If not, a normal copy operation is processed, the completion of the main timer is awaited (S224), and the routine returns to the previously described step S206. When it is determined that memory card 903 is present in step S210, processing is performed in accordance with the data from card 903, i.e., the data from memory card 903 are read (S212) and stored in RAM 624 (S214), the eraser 4 is controlled based upon said stored data, and the copy operation is processed (S216). Following the completion of the copying operation, power is supplied to solenoid 206 and the memory card 903 is ejected from the insert section 25.

Thereafter, the routine continues to step S222. In addition, memory card 903 may also be ejected immediately after the data stored therein have been read.

Although the present invention has been fully described by way of example with reference to the accompanying drawings, it is to be noted that various changes and modifications will be apparent to those skilled in the art. Therefore, unless otherwise such changes and modifications depart from the scope of the present invention, they shall be construed as being included therein.

What is claimed is:

1. An image editing system comprising:

a copy device including a document support table for supporting an original document to be copied and image forming means capable of copying an arbitrary area of the original document;

an input device separate from said copy device for inputting area data which define an area of the original document;

a memory device which is attachable to and detachable from said copy device and said input device and is capable of storing the input area data therein and feeding out the stored data therefrom;

said memory device storing the input area data when said memory device is attached to said input device;

said memory device feeding out the stored data therefrom to said copy device when said memory device is attached to said copy device; and a control device for controlling said copy device so as to copy the area of original document defined by the data fed from said memory device.

2. An image editing system as claimed in claim 1, wherein said input device comprises means for inputting coordinates data.

3. An image editing system as claimed in claim 1, therein said input device comprises means for displaying the input data.

4. An image editing system as claimed in claim 1, wherein said input device comprises means for printing the input data.

5. An image editing system as claimed in claim 1, wherein said memory device comprises an electrically erasable and programmable read only memory.

6. An image editing system comprising:

an input device for inputting area data;

a memory for storing the input area data;

a copy device;

said input device being separate from said copy device;

said memory device being attachable to said input device and said copy device, and storing the input area data when said memory device is attached to said input device; and said copy device including means for supporting an original document to be copied and means for forming the specific area of the original document which corresponds to the area data stored in memory device attached to said copy device.

7. An image editing system as claimed in claim 6, wherein said input device further comprising means for confirming that the stored data is equal to the input data.

8. An image editing system as claimed in claim 7, wherein said input device further comprising means for displaying a malfunction of the memory device when the stored data does not equal to the input data.

9. An image editing system comprising:

a copy device including a document support table for supporting an original document to be copied and an image forming means for performing an edited image copying of the original document;

an input device separate from said copy device for inputting data concerning the edited image copying;

a memory device which is attachable to and detachable from said copy device and said input device and is capable of storing the input editing data therein and feeding out the stored data therefrom said memory device storing the input data therein when said memory device is attached to said input device;

said memory device feeding out the stored data therefrom to said copy device when said memory device is attached to said copy device; and based on the data fed by said memory device.

10. A program copy system comprising;

a copy device including a document support table for supporting an original document to be copied and an image forming means for copying the original document;

an input device separate from said copy device for inputting programmed control data;

a memory device which is attachable to and detachable from said copy device and said input device and is capable of storing the input programmed control data therein and feeding out the stored data therefrom;

said memory device storing the input data therein when said memory device is attached to said input device; data said memory device feeding out the stored therefrom to said copy device when said memory device is attached to said copy device; and a control device for controlling said copy device based on the data fed by said memory device.

11. An image forming apparatus comprising:

memory device capable of storing image forming data;

main body including an image forming means and a memory device receiving portion, said memory device being attachable to said receiving portion;

means for reading out the data stored in said memory device attached to the receiving portion and for controlling the image forming means based on the read out data; and means for ejecting said memory device from the receiving portion after the data is read out.

12. An image forming apparatus comprising:

memory device capable of storing image forming data;

main body including an image forming means and a memory device receiving portion, said memory device being attachable to said receiving portion;

means for reading out the data stored in said memory device attached to the receiving portion and for controlling the image forming means based on the read out data; and means for ejecting said memory device from the receiving portion after the completion of image forming operation based on the read out data.

* * * * *